US007127873B2

(12) United States Patent
Tacchi et al.

(10) Patent No.: US 7,127,873 B2
(45) Date of Patent: Oct. 31, 2006

(54) PRODUCT PACKING UNIT

(75) Inventors: Alver Tacchi, Bologna (IT); Mario Spatafora, Granarolo (IT)

(73) Assignee: G.D. Societa' per Azioni, Bologna (IT)

( * ) Notice: Subject to any disclaimer, the term of this patent is extended or adjusted under 35 U.S.C. 154(b) by 63 days.

(21) Appl. No.: 10/991,333

(22) Filed: Nov. 17, 2004

(65) Prior Publication Data

US 2005/0126121 A1 Jun. 16, 2005

(30) Foreign Application Priority Data

Nov. 21, 2003 (IT) ..... BO2003A0706

(51) Int. Cl.
*B65B 11/02* (2006.01)
*B65B 41/10* (2006.01)

(52) U.S. Cl. ..... 53/234; 53/228; 53/389.4

(58) Field of Classification Search ..... 53/466, 53/228, 230, 231, 232, 234, 389.4
See application file for complete search history.

(56) References Cited

U.S. PATENT DOCUMENTS 2,279,843 A 4/1942 Smith et al.
4,358,920 A * 11/1982 Kanai et al. ..... 53/234
4,385,479 A * 5/1983 Focke ..... 53/234
4,617,780 A * 10/1986 Focke et al. ..... 53/234
4,866,912 A * 9/1989 Deutsch ..... 53/234
4,909,020 A * 3/1990 Focke ..... 53/234
5,406,775 A * 4/1995 Tacchi et al. ..... 53/234
5,461,954 A * 10/1995 Boriani et al. ..... 53/466
5,845,464 A * 12/1998 Draghetti ..... 53/466
6,904,738 B1 * 6/2005 Spatafora et al. ..... 53/466

FOREIGN PATENT DOCUMENTS

EP 0 574 788 12/1993
EP 0 792 805 9/1997
EP 0 940 339 9/1999

* cited by examiner

*Primary Examiner*—Louis Huynh
(74) *Attorney, Agent, or Firm*—Ladas and Parry LLP

(57) ABSTRACT

A unit for packing products, wherein a feed line, for supplying a strip of packing material, feeds the strip with a given movement to a cutting device for cutting the strip into a succession of sheets of packing material, and then to a feed station for feeding each sheet to a packing wheel moving with a further movement through the feed station; and wherein a compensating roller, having a compensating store, is interposed between the cutting device and the feed station.

7 Claims, 7 Drawing Sheets

PRODUCT PACKING UNIT

BACKGROUND OF THE INVENTION

More specifically, the present invention relates to a unit for packing groups of products, the unit comprising a packing wheel operating with a first movement; a feed station for feeding packing material in sheets to said packing wheel; a feed line operating with a second movement to feed packing material in the form of a continuous strip; a cutting device located along said feed line to cut the continuous strip into said sheets; and feed means for feeding said sheets successively to said feed station; said packing wheel comprising a number of seats, each for receiving a respective said product, and a number of gripping means, each associated with a respective said seat and travelling through said feed station with said first movement to receive a respective said sheet.

In known packing units, particularly packing units normally used in the tobacco industry for packing groups of packets of cigarettes, the continuous strip is normally fed continuously, the packing wheel is normally rotated in steps, and the feed means comprise an intermediate suction roller located immediately downstream from the cutting device, and which first receives the end of the continuous strip before it is cut, and then feeds a sheet, as soon as it is cut off, to the packing wheel.

Operation of the intermediate roller is therefore conditioned by both the feed movement of the continuous strip, and the rotation movement of the packing wheel, and should, theoretically, be controlled to rotate with a surface speed at least equal, at the continuous strip receiving point and instant by instant, to the travelling speed of the continuous strip, and at most equal, at the transfer point to the packing wheel and instant by instant, to the travelling speed of the packing wheel.

When, as is normally the case, for example, in packing units for packing groups of packets of cigarettes, the continuous strip and the packing wheel travel at different speeds, and the intermediate roller receives the continuous strip as it is transferring a sheet to the packing wheel, control of the intermediate roller, which is normally driven by a main motor of the packing unit and speed-controlled by cam systems, is obviously extremely difficult and not always satisfactory.

SUMMARY OF THE INVENTION

It is an object of the present invention to provide a unit for packing groups of products, designed to satisfactorily transfer sheets of packing material from a cutting station, for cutting a continuous strip, to a packing wheel.

According to the present invention, there is provided a unit for packing products, the unit comprising a packing wheel operating with a first movement; a feed station for feeding packing material in sheets to said packing wheel; a feed line operating with a second movement to feed packing material in the form of a continuous strip; a cutting device located along said feed line to cut the continuous strip into said sheets; and feed means for feeding said sheets successively to said feed station; said packing wheel comprising a number of seats, each for receiving a respective said product, and a number of gripping means, each associated with a respective said seat and travelling through said feed station with said first movement to receive a respective said sheet; the unit being characterized in that said feed means comprise a movable compensating assembly in turn comprising a movable compensating store for said packing material.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
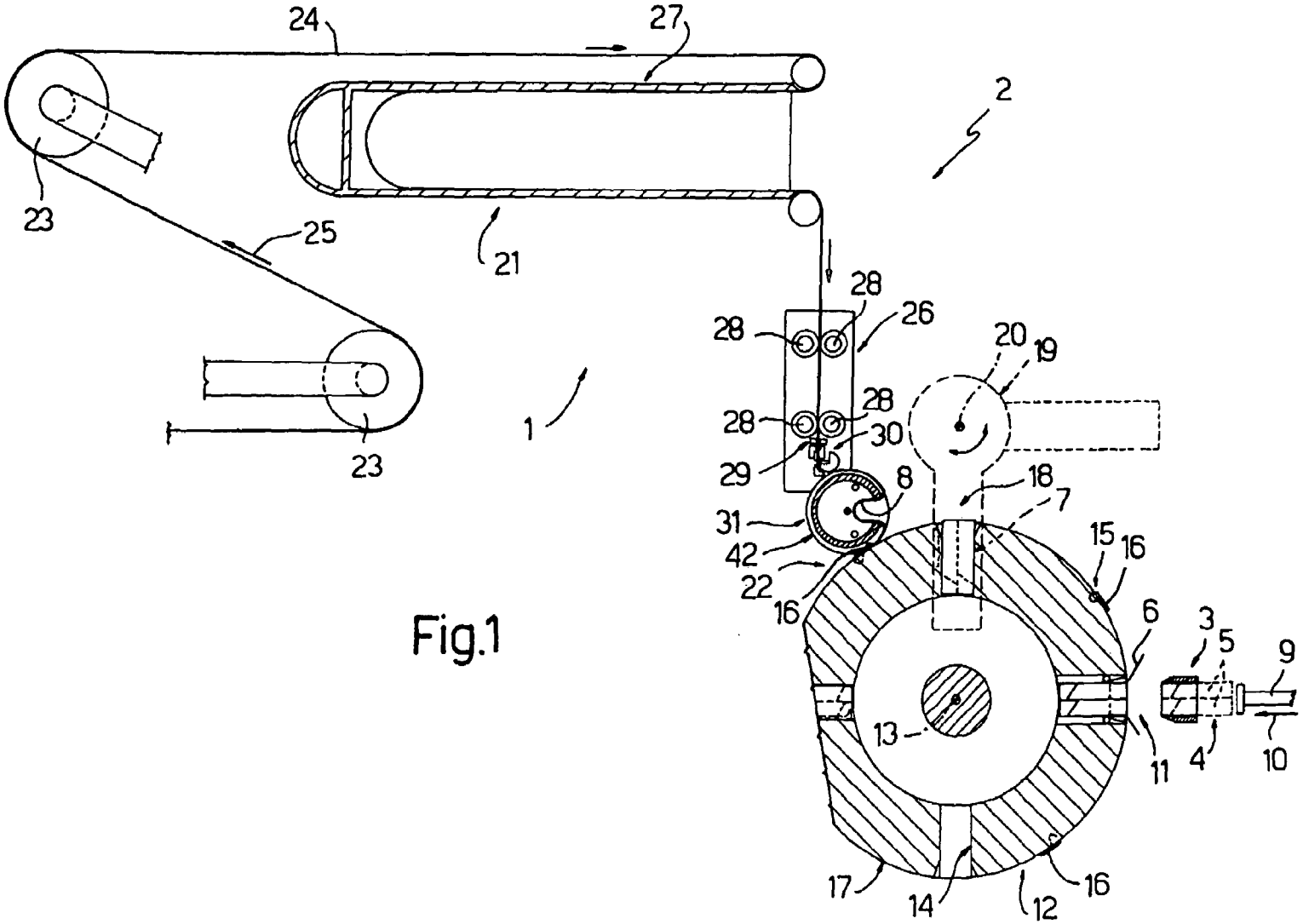
FIG. 1 shows a partial, schematic side view of a preferred embodiment of the packing unit according to the present invention.

Number 1 in FIG. 1 indicates as a whole a packing unit of a cartoning machine 2, unit 1 receiving, at an input 3, a succession of groups 4 of packets 5 of cigarettes together with respective blanks 6 of packing material; folding blanks 6 about respective groups 4 to form a succession of packed groups 7; and successively feeding a second packing wheel (not shown) with packed groups 7 together with respective sheets 8 of overwrapping material, which are folded successively about respective packed groups 7 to form a succession of overwrapped groups (not shown).

In the example shown, each group 4 comprises ten packets 5 arranged in two superimposed rows, and is in the form of a rectangular parallelepiped, which is positioned with its longitudinal axis perpendicular to the FIG. 1 plane, and is fed to unit 1 by a pusher 9 located at a loading station 11 and acting in a substantially horizontal direction 10 parallel to the FIG. 1 plane.

Packing unit 1 comprises a packing wheel 12 tangent to loading station 11 and rotating anticlockwise in steps about an axis 13 perpendicular to the FIG. 1 plane. Packing wheel 12 comprises a number of seats 14, each paired with a respective gripper 15 located downstream from seat 14, in the rotation direction of packing wheel 12, and comprising a jaw 16, which faces rearwards in the rotation direction of packing wheel 12, projects outwards with respect to a cylindrical outer surface 17 of packing wheel 12, and is rotated, by a known cam device (not shown) and about a respective axis substantially coincident with a respective generating line of cylindrical surface 17, between a closed work position contacting cylindrical surface 17, and a normal open position.

When a seat 14 is arrested at loading station 11, the adjacent seat 14, downstream in the rotation direction of packing wheel 12, is arrested at a packing station 18 where packing wheel 12 is connected to a known folding device 19, which oscillates, about an axis 20, between a raised rest position and a lowered work position in which folding device 19 performs a sequence of operations to fold each blank 6 completely about respective group 4 and form a respective packed group 7.

Packing unit 1 also comprises a feed line 21 for feeding sheets 8 of overwrapping material to packing wheel 12 at a feed station 22 located downstream from packing station 18 and upstream from a transfer station (not shown) to the second wheel (not shown). Feed line 21 comprises a number of guide pulleys 23 for guiding a continuous strip 24 of overwrapping material unwound off a reel (not shown) in a direction 25 by a feed unit 26 pulling strip 24 via a known pneumatic tensioning device 27 with a take-up well.

In the example shown, feed unit 26 comprises, successively in direction 25, two pairs of opposite, counter-rotating traction rollers 28 for strip 24; a pneumatic traction assembly 29 immediately downstream from rollers 28; a cutting assembly 30 for cutting strip 24 transversely into a succession of sheets 8 of overwrapping material; and a feed assembly 31 for feeding a sheet 8 of overwrapping material, just cut off strip 24, to feed station 22.

Cutting assembly 30 comprises a blade 32 oscillating about an axis parallel to axis 13; and a fixed cutting block 33 facing blade 32 and on the opposite side of strip 24 to blade 32.

Figure 3:
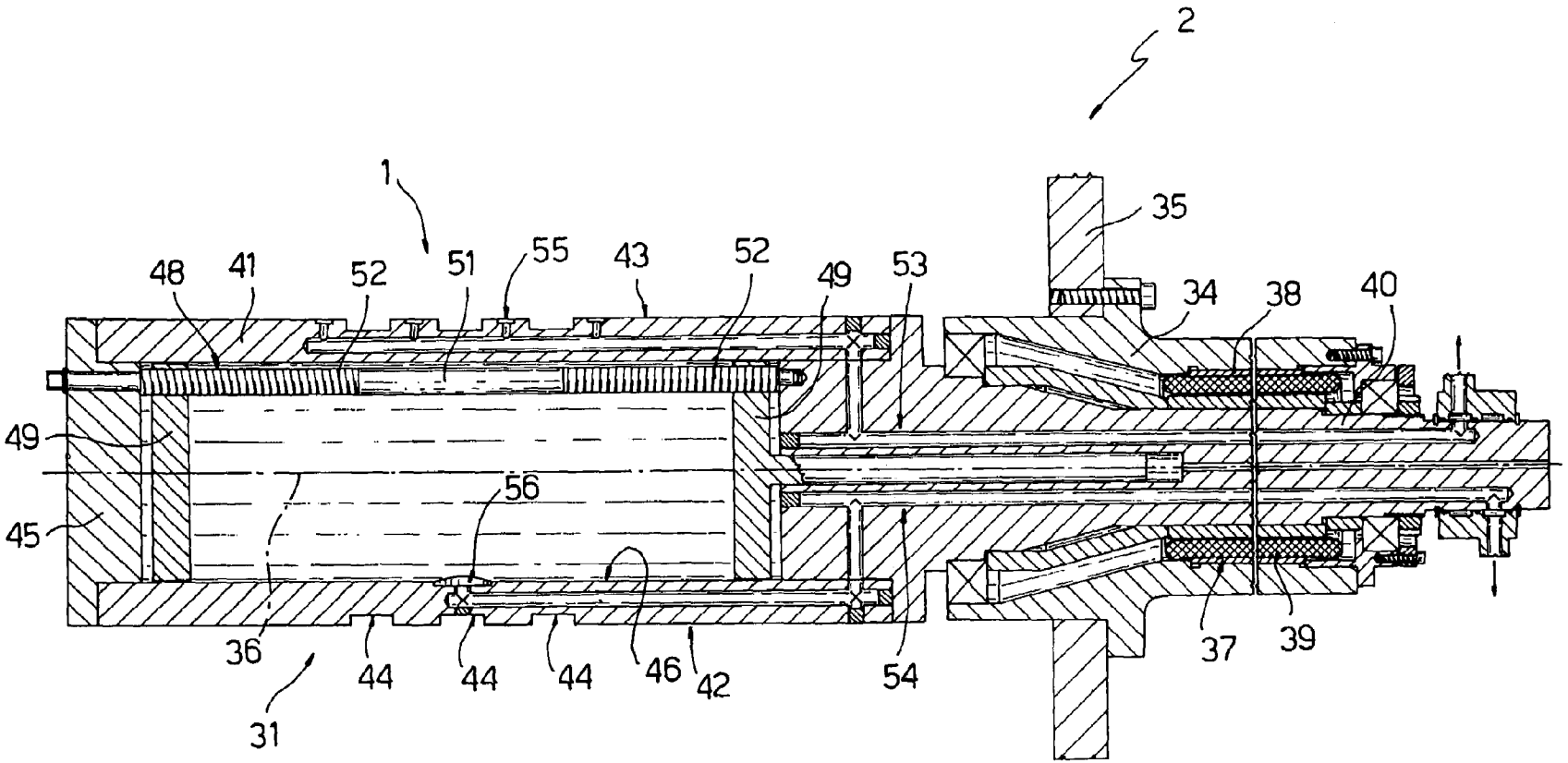
FIG. 3 shows a section along line III—III in FIG. 2.
Figure 4:
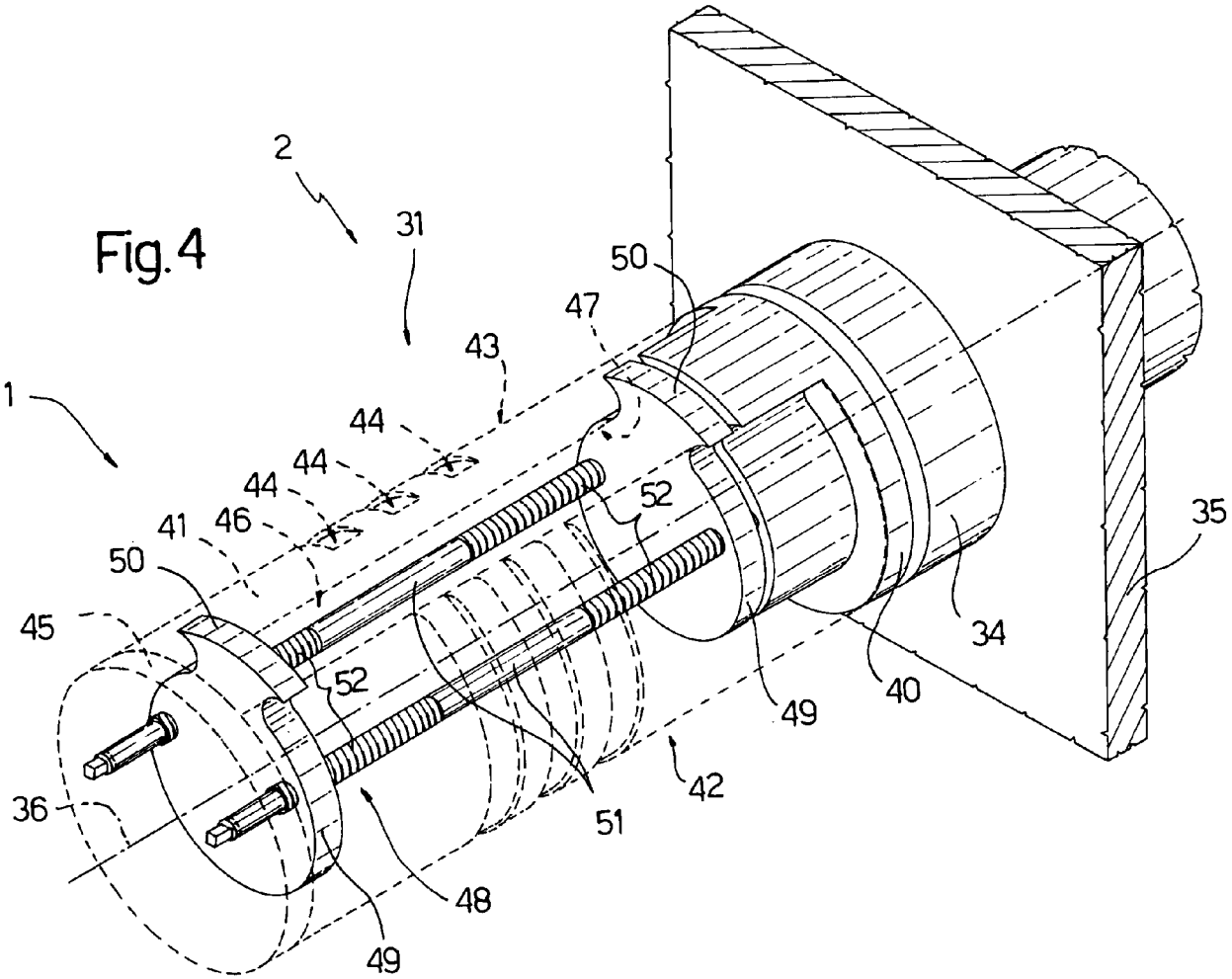
FIG. 4 shows a view in perspective of a detail in FIG. 2.

As shown in FIGS. 3 and 4, feed assembly 31 comprises a tubular body 34 fitted through a fixed annular supporting plate 35 and having an axis 36 parallel to axis 13. Tubular body 34 houses an electric motor 37, a stator 38 of which is integral with tubular body 34, and a rotor 39 of which is fitted to a shaft 40 coaxial with axis 36. Shaft 40 comprises a portion outside tubular body 34 and fitted inside an end portion of a tubular casing 41 of a compensating roller 42, which is coaxial with axis 36 and has an outer surface 43 tangent to cylindrical surface 17 of packing wheel 12 at feed station 22, and having a number of central grooves 44 enabling passage of grippers 15, in the open position, through feed station 22.

Figure 2:
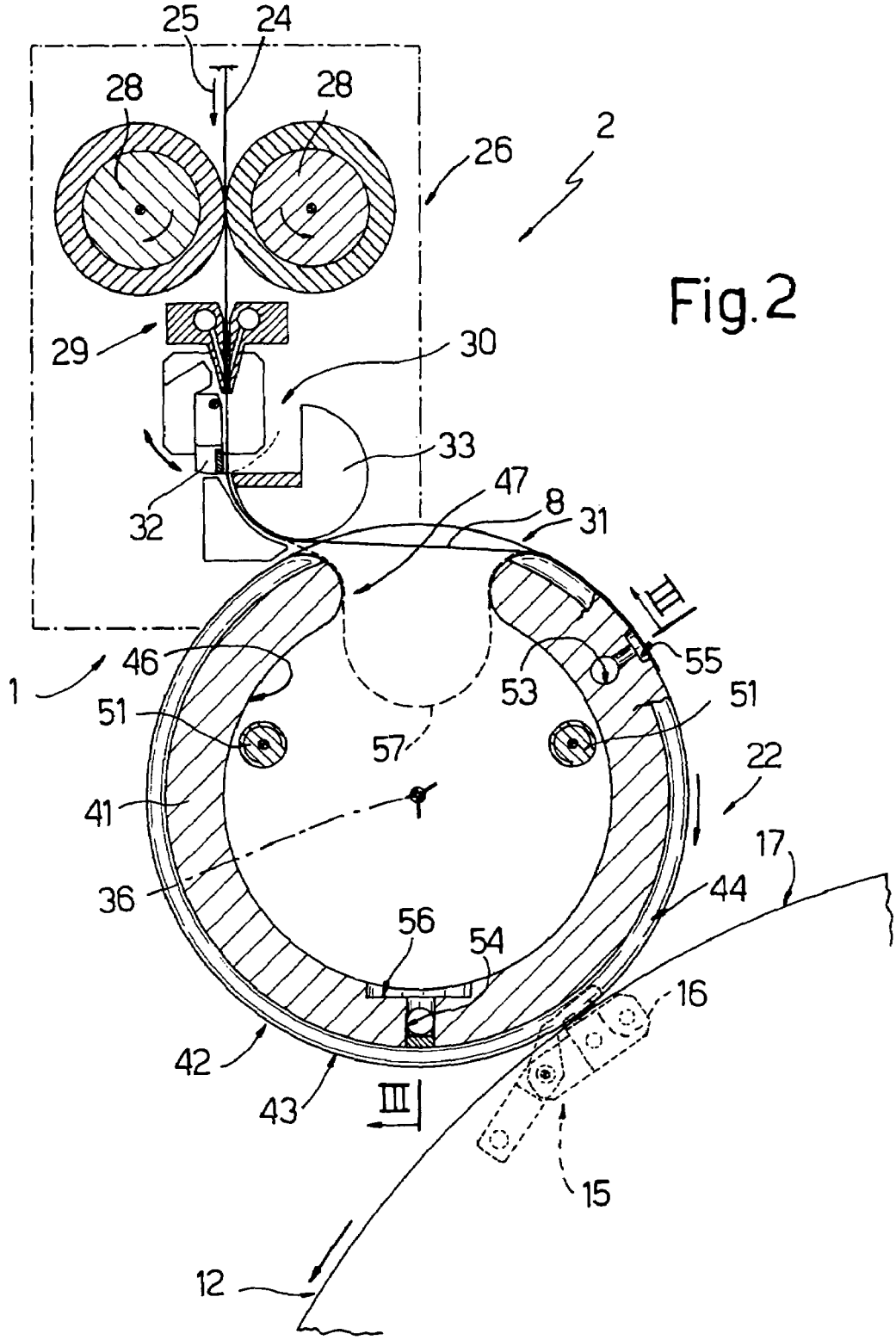
FIG. 2 shows a larger-scale, partly sectioned view of a detail of the FIG. 1 packing unit.

As shown in FIG. 3, casing 41 is closed at one end by shaft 40 and at the other end by a plug 45, which combines with shaft 40 to define the ends of a chamber 46 inside casing 41 and communicating with the outside through an axial slot 47 (FIG. 2) with rounded lateral walls. The length of chamber 46 is adjustable by means of an adjusting device 48 comprising two walls 49, which are mounted inside chamber 46, crosswise to axis 36, to slide, parallel to axis 36, along chamber 46, and have respective radial appendixes 50 engaging and sliding along slot 47. Adjusting device 48 also comprises two screws 51, each of which extends through plug 45, parallel to axis 36, is axially fixed with respect to shaft 40, and comprises two oppositely threaded end portions 52 connected to respective walls 49 by respective screw-nut screw couplings to move walls 49 in opposite directions when screws 51 are activated.

Feed assembly 31 also comprises two suction circuits 53 and 54 extending along shaft 40 and both communicating with an external suction pump (not shown); circuit 53 comes out at outer surface 43 of casing 41 through a number of holes 55 immediately downstream from slot 47 in the rotation direction of the compensating roller; and circuit 54 comes out inside chamber 46 through a central hole 56 diametrically opposite slot 47.

In actual use, when a seat 14, housing a respective group 4 and a respective partly folded blank 6, is arrested at packing station 18 (FIG. 1), the relative gripper 15 is arrested at feed station 22, and folding device 19, formerly in the raised rest position, is moved into the lowered work position to finish folding blank 6 and obtain a packed group 7 in known manner.

Figure 5:
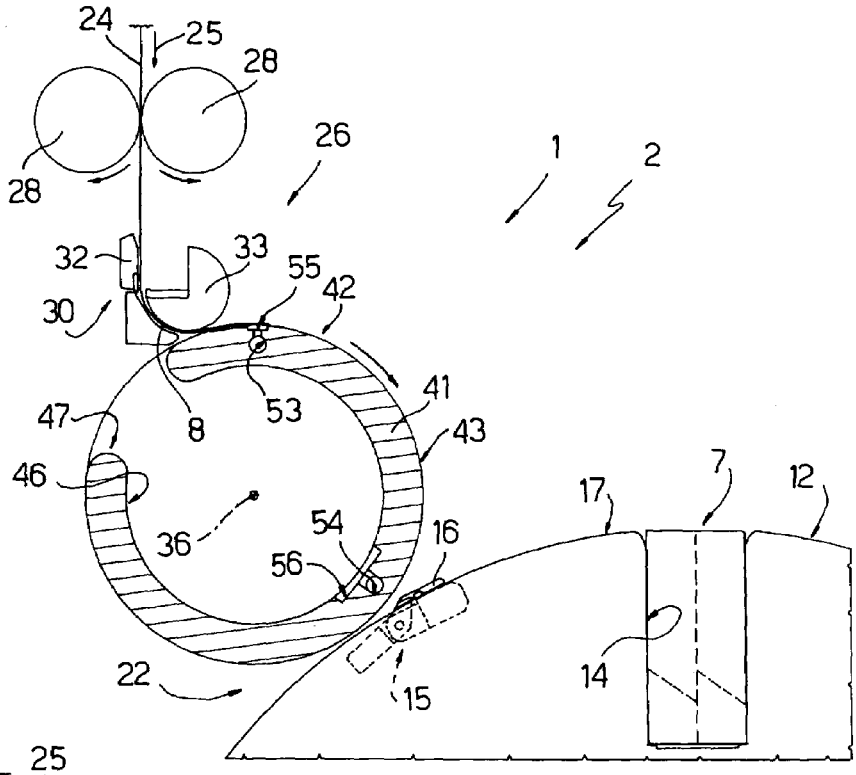
FIGS. 5 to 9 show the FIG. 2 detail in respective different operating positions.

At the same time, as shown in FIG. 5, strip 24, formerly stationary at cutting assembly 30, begins moving forward, and its leading end, on reaching the periphery of compensating roller 42, whose walls 49 have already been adjusted to obtain a chamber 46 of a length approximately equal to but no less than the width of strip 24, is sucked by holes 55 onto outer surface 43. During this operation, packing wheel 12 remains stationary, while compensating roller 42 rotates (clockwise in FIG. 5) about axis 36 at a surface speed at least equal to the travelling speed imparted to strip 24 by feed unit 26.

Figure 6:
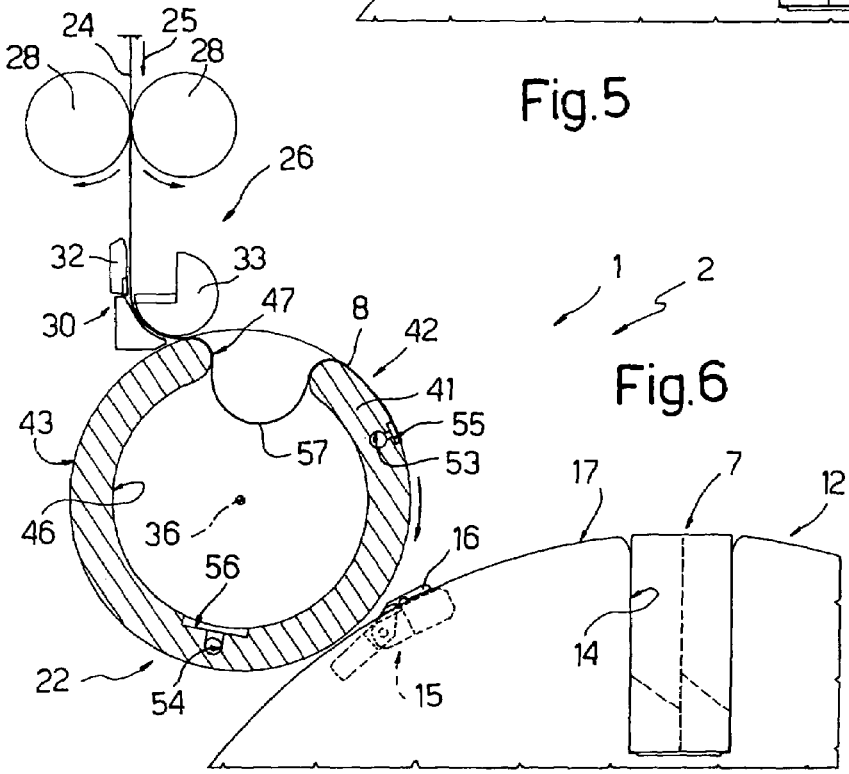

Since sheets 8 of overwrapping material are to be released to packing wheel 12 at a speed substantially equal to the surface speed of packing wheel 12 at the time the sheets are released, and since packing wheel 12 is currently stationary, electric motor 37 is speed-controlled to begin slowing down as soon as slot 47 (FIG. 6) moves past cutting assembly 30, and a portion of strip 24 begins to become tensioned across slot 47.

As a consequence of the electric motor slowing down, the portion of strip 24 not taken up by compensating roller 42 is sucked inside chamber 46 through slot 47 by the vacuum generated inside chamber 46 by suction circuit 54 through hole 56, and forms inside chamber 46 a bend 57 of a length proportional to the difference between the travelling speed of strip 24 and the surface speed of compensating roller 42.

In other words, chamber 46 acts as a compensating store for strip 24, and makes the surface speed of compensating roller 42 independent of feed line 21 and the travelling speed of strip 24.

Figure 7:
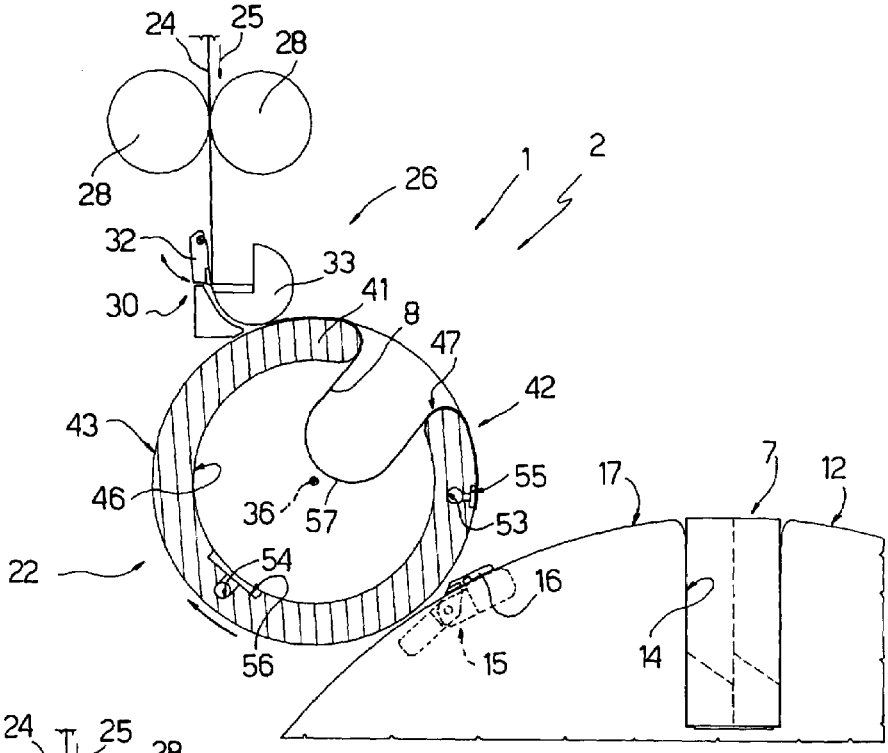

When the total portion of strip 24 released to compensating roller 42 reaches a length equal to the length of a sheet 8 of overwrapping material (FIG. 7), supply of strip 24 is arrested temporarily, so that part of strip 24 is absorbed by tensioning device 27 to allow cutting assembly 30 to cut strip 24 crosswise and detach a sheet 8 of overwrapping material from strip 24.

Figure 8:
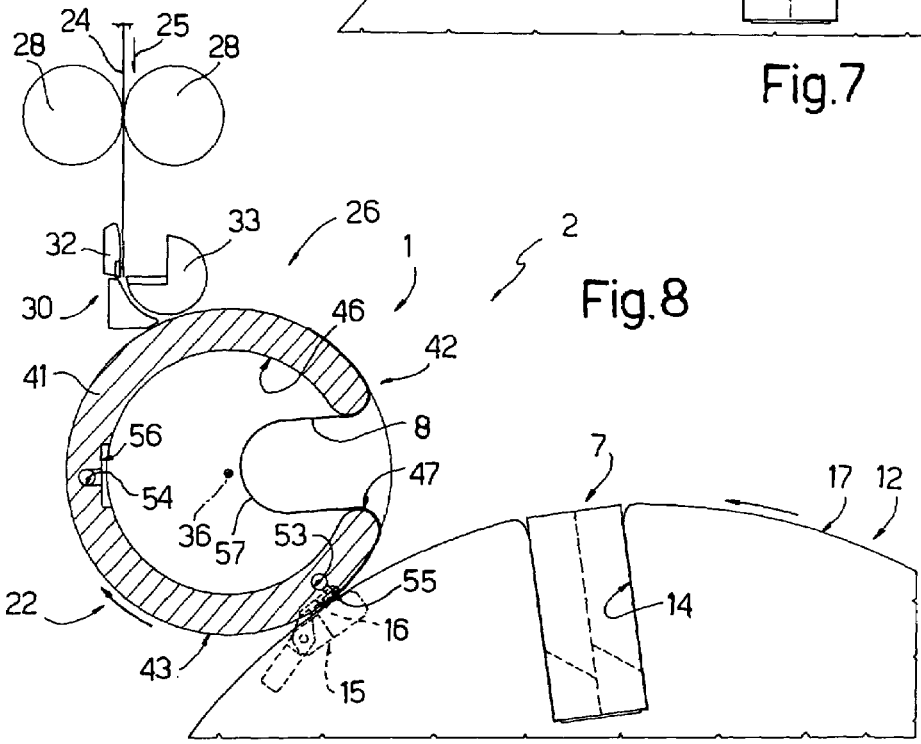
Figure 9:
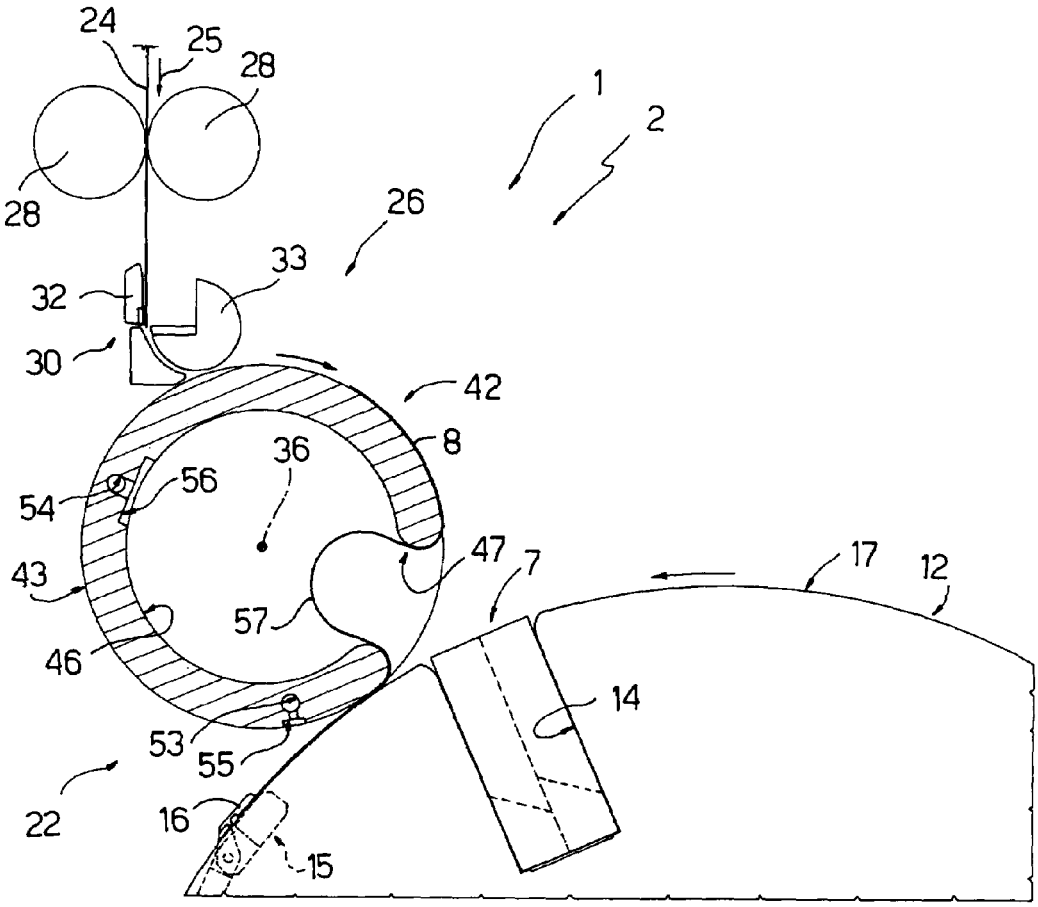

During this operation, compensating roller 42 continues rotating and slowing down, and is eventually positioned with holes 55 close to the periphery of packing wheel 12. At this point, packing wheel 12 begins rotating once more about axis 13 (FIG. 8) to move the gripper 15, previously located immediately upstream from compensating roller 42, at gradually increasing surface speed through feed station 22. During this movement, electric motor 37 is also accelerated, and is controlled so that holes 55 travel through feed station 22 at the same speed as and in time with gripper 15, which is opened and then closed to grip the leading end of sheet 8 of overwrapping material and gradually remove sheet 8 of overwrapping material from compensating roller 42 (FIG. 9).

At this point, compensating roller 42 is again slowed down to prevent sheet 8 of overwrapping material from being released faster than it is taken up by packing wheel 12, and to allow packing wheel 12 to eliminate bend 57 before slot 47 gets past feed station 22.

In other words, chamber 46 also acts as a compensating store for sheet 8 of overwrapping material, and makes the surface speed of compensating roller 42 independent of packing wheel 12 once gripper 15 grips the leading end of sheet 8 of overwrapping material.

Once sheet 8 of overwrapping material is released, compensating roller 42 is restored to the FIG. 5 start position to feed another sheet 8 of overwrapping material to packing wheel 12.

The invention claimed is:

1. A unit for packing products, the unit comprising a packing wheel (12) operating with a first movement;

a feed station (22) for feeding packing material (8) in sheets to said packing wheel (12);

a feed line (21) operating with a second movement to feed packing material (24) in the form of a continuous strip;

a cutting device (30) located along said feed line (21) to cut the continuous strip (24) into said sheets (8); and feed means (26) for feeding said sheets (8) successively to said feed station (22);

wherein said packing wheel (12) comprises a number of seats (14), each for receiving a respective said product (7), and a number of gripping means (15), each associated with a respective said seat (14) and travelling through said feed station (22) with said first movement to receive a respective said sheet (8);

wherein said feed means (26) comprises a movable compensating assembly (31) in turn comprising a movable compensating store (46, 47, 54) for said packing material (24, 8), a roller (42) substantially tangent to the packing wheel (12) at said feed station (22) and having an axis (36) parallel to said packing wheel (12), and drive means (37) for rotating said roller (42) around said axis (36); said roller (42) having an outer casing (41) having first suction means (53) for retaining said packing material (24, 8); and said movable compensating store (46, 47, 54) comprises an axial slot (47) formed through said casing (41), a chamber (46) inside said casing (41) and communicating with the outside through said slot (47), and second suction means (54) which comes out inside said chamber (46) to form a vacuum in said chamber (46).

2. A unit as claimed in claim 1, wherein said first suction means (53) is located on said casing (41), downstream from said slot (47) in a travelling direction of said slot (47) about said axis (36).

3. A unit as claimed in claim 1, wherein said second suction means (54) is located inside said chamber (46) and face said siot (47).

4. A unit as claimed in claim 1, wherein said chamber (46) and said slot (47) extend axially by a given length along said roller (42); said roller (42) being fitted with adjusting means (48) to adjust said length as a function of a width of said packing material (24, 8).

5. A unit as claimed in claim 4, wherein said adjusting means (48) comprises two walls (49) crosswise to said axis (36) and mounted inside said chamber (46); and actuating means (51) fitted to said walls (49) to move the walls (49) in opposite directions along said casing (41) and parallel to said axis (36).

6. A unit as claimed in claim 5, wherein each said wall (49) has an appendix (50) engaging and sliding along said slot (47).

7. A unit as claimed in claim 1, wherein said drive means (37) comprises an electric motor (37) independent of said packing wheel (12).

* * * * *

UNITED STATES PATENT AND TRADEMARK OFFICE

CERTIFICATE OF CORRECTION

PATENT NO. : 7,127,873 B2
APPLICATION NO. : 10/991333
DATED : October 31, 2006
INVENTOR(S) : Alver Tacchi et al.

It is certified that error appears in the above-identified patent and that said Letters Patent is hereby corrected as shown below:

Title Page

On title page, item 73, Assignee "D." should read -- D --.

Signed and Sealed this

Sixth Day of February, 2007

JON W. DUDAS
*Director of the United States Patent and Trademark Office*